US011311083B2

(12) United States Patent
They

(10) Patent No.: US 11,311,083 B2
(45) Date of Patent: Apr. 26, 2022

(54) LIFEGUARD IDENTIFICATION DEVICE

(71) Applicant: They, Galveston, TX (US)

(72) Inventor: They, Galveston, TX (US)

( * ) Notice: Subject to any disclaimer, the term of this patent is extended or adjusted under 35 U.S.C. 154(b) by 119 days.

(21) Appl. No.: 16/802,086

(22) Filed: Feb. 26, 2020

(65) Prior Publication Data

US 2021/0259325 A1 Aug. 26, 2021

(51) Int. Cl.
*A44C 15/00* (2006.01)
*G09F 3/00* (2006.01)

(52) U.S. Cl.
CPC ..... *A44C 15/005* (2013.01); *G09F 3/005* (2013.01)

(58) Field of Classification Search
CPC ..... A01K 27/001; A44C 5/0053; A44C 5/18; A44C 15/005; G09F 3/00; G09F 3/005
See application file for complete search history.

(56) References Cited

U.S. PATENT DOCUMENTS 2,798,458 A * 7/1957 Odermatt ..... A01K 27/001 119/858
4,091,766 A * 5/1978 Colliard ..... A01K 27/005 119/858
4,601,538 A * 7/1986 Valkenburg ..... G08B 5/004 359/519
4,909,189 A * 3/1990 Minotti ..... A01K 27/006 119/859
6,079,135 A * 6/2000 Ruiz ..... G09F 3/205 40/316
7,631,976 B2 * 12/2009 Rennick ..... A45F 5/02 359/515
9,907,292 B2 * 3/2018 Dudek ..... A01K 27/001
2007/0144047 A1 * 6/2007 Singh ..... A44C 5/0015 40/633
2014/0116356 A1 * 5/2014 Balenzano ..... A01K 27/006 119/858
2016/0066543 A1 * 3/2016 Couillard ..... A01K 27/001 119/864
2019/0297966 A1 * 10/2019 Wisniewski ..... A41D 13/0512
2021/0307294 A1 * 10/2021 Kimbel ..... A01K 27/006

* cited by examiner

*Primary Examiner* — Patricia L. Nordmeyer
(74) *Attorney, Agent, or Firm* — Benjamin Aaron Adler

(57) ABSTRACT

Provided herein are identification collars or devices for a lifeguard. The identification collar and the identification device are generally unitary collars to which a plurality of reflective elements and a plurality of indicia are attached circumferentially on the outer surface of the collar so the wearer is easily identified from any direction. The unitary collars are made from stretchable elastic material.

16 Claims, 1 Drawing Sheet

LIFEGUARD IDENTIFICATION DEVICE

BACKGROUND OF THE INVENTION

Field of the Invention

The invention relates generally to the fields of beach and swimming pool safety. More specifically, the present invention is directed to an identification collar for lifeguards easily visible to beach goers or patrons of a public swimming pool.

Description of the Related Art

Each year, about 4,000 people drown in the United States. Drowning is the leading cause of unintentional injury or death among all ages and particularly among children. In the United States, over 300 million people visit beaches and open waters each year. This warrants the need for local government organizations to deploy sufficient trained lifeguards at these locations for effective patron surveillance and supervision. While most tourist hotspots are generally equipped with the basic life-saving accessories, identifying a lifeguard in high traffic beaches in the midst of thousands of people is not an easy task.

Thus, there is a need in the art for tools and devices that help patrons to quickly distinguish lifeguards from fellow patrons. The present invention fulfills this longstanding need and desire in the art.

SUMMARY OF THE INVENTION

The present invention is directed to an identification collar for a lifeguard. The identification collar comprises a unitary collar body having an upper edge and a lower edge that define a center region therebetween and comprises a stretchable fabric. At least one pair of reflective elements are longitudinally disposed in parallel around an outer surface of the unitary collar body at the upper edge and at the lower edge thereof. The present invention is directed to a related identification collar further comprising a plurality of indicia disposed circumferentially to the center region of the unitary collar body.

The present invention also is directed to a lifeguard identification device. The lifeguard identification device comprises a unitary collar having an outer surface and an inner surface. A plurality of reflective elements and a plurality of indicia are circumferentially disposed on the outer surface of the collar. The present invention is directed to a related identification collar further comprising an indicia fabric having a vertical dimension smaller than a vertical dimension from a lower edge to an upper edge of the unitary collar, said indicia disposed thereon.

Other and further aspects, features, and advantages of the present invention will be apparent from the following description of the presently preferred embodiments of the invention given for the purpose of disclosure.

BRIEF DESCRIPTION OF THE DRAWINGS

So that the matter in which the above-recited features, advantages and objects of the invention, as well as others that will become clear, are attained and can be understood in detail, more particular descriptions of the invention briefly summarized above may be had by reference to certain embodiments thereof that are illustrated in the appended drawings. These drawings form a part of the specification. It is to be noted, however, that the appended drawings illustrate preferred embodiments of the invention and therefore are not to be considered limiting in their scope.

DETAILED DESCRIPTION OF THE PRESENT INVENTION

Figure 1:
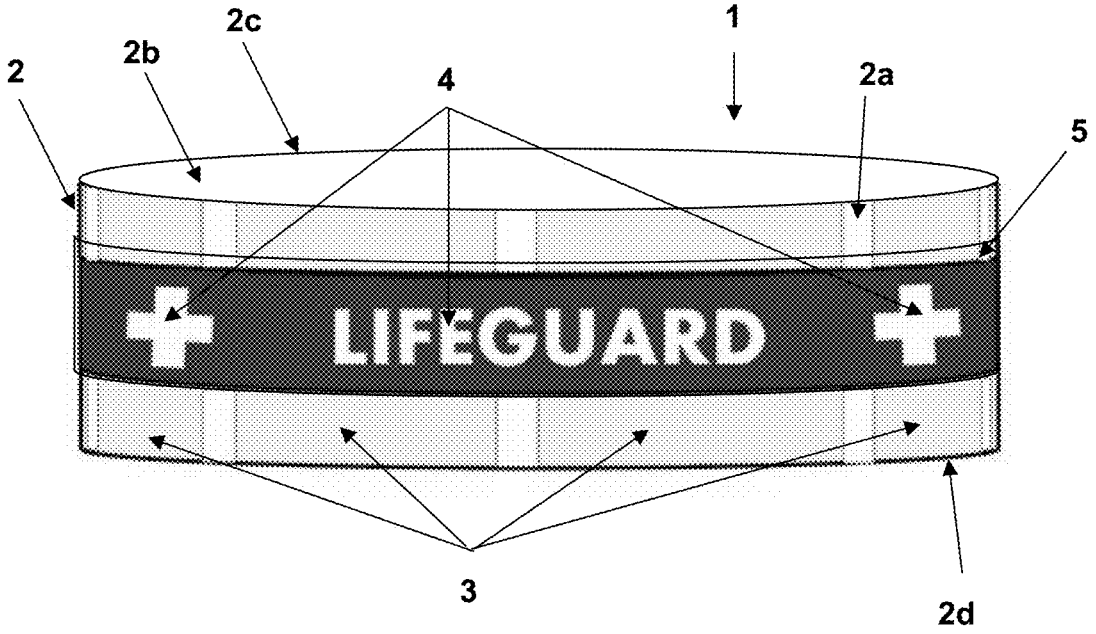
FIG. 1 is a front view of a lifeguard identification device.

For convenience, before further description of the present invention, certain terms employed in the specification, examples and appended claims are collected herein. These definitions should be read in light of the remainder of the disclosure and understood as by a person of skill in the art. Unless defined otherwise, all technical and scientific terms used herein have the same meaning as commonly understood by a person of ordinary skill in the art.

The articles "a" and "an" when used in conjunction with the term "comprising" in the claims and/or the specification, may refer to "one", but it is also consistent with the meaning of "one or more", "at least one", and "one or more than one". Some embodiments of the invention may consist of or consist essentially of one or more elements, components, method steps, and/or methods of the invention. It is contemplated that any composition, component or method described herein can be implemented with respect to any other composition, component or method described herein.

The term "or" in the claims refers to "and/or" unless explicitly indicated to refer to alternatives only or the alternatives are mutually exclusive, although the disclosure supports a definition that refers to only alternatives and "and/or".

The terms "comprise" and "comprising" are used in the inclusive, open sense, meaning that additional elements may be included.

The term "including" is used herein to mean "including, but not limited to". "Including" and "including but not limited to" are used interchangeably.

As used herein, the term "about" refers to a numeric value, including, for example, whole numbers, fractions, and percentages, whether or not explicitly indicated. The term "about" generally refers to a range of numerical values (e.g., +/−5-10% of the recited value) that one of ordinary skill in the art would consider equivalent to the recited value (e.g., having the same function or result). In some instances, the term "about" may include numerical values that are rounded to the nearest significant figure. For example, a vertical dimension of the collar from 1.8 inches to 3.3 inches is encompassed by about 2 inches to about 3 inches.

As used herein, the terms "unitary collar body", "unitary collar" and "collar" are used interchangeably.

As used herein, the term "stretchable elastic" when referring to a fabric or material refers to a fabric or material that is not only able to be made longer or wider or to have an increased circumference by a pulling action, but will spontaneously return to its original shape absent the pulling action.

In one embodiment of the present invention there is provided an identification collar for a lifeguard, comprising a unitary collar body having an upper edge and a lower edge that define a center region therebetween and comprising a stretchable fabric; and at least one pair of reflective elements longitudinally disposed in parallel around an outer surface of the unitary collar body at the upper edge and at the lower edge thereof.

Further to this embodiment the identification collar may comprise a plurality of indicia disposed circumferentially to the center region of the unitary collar body. In this further embodiment the indicia identify a user as a certified lifeguard. In another further embodiment the identification collar may comprise a stretchable indicia fabric secured circumferentially to the center region of the unitary collar body and a plurality of indicia circumferentially secured thereon. In this further embodiment the indicia fabric may be made from a natural stretchable elastic fabric or a synthetic stretchable elastic fabric or a combination thereof.

In all embodiments the unitary collar body may have a vertical dimension between the upper edge and the lower edge of about 2 inches to about 3 inches. Also in all embodiments the unitary collar body may be stretchable to a circumference of about 20 inches to about 25 inches. In addition the unitary collar body may be made from a stretchable elastic fabric.

In another embodiment of the present invention there is provided a lifeguard identification device, comprising a unitary collar having an outer surface and an inner surface; a plurality of reflective elements circumferentially disposed on the outer surface of the collar; and a plurality of indicia circumferentially disposed on the outer surface of the collar.

Further to this embodiment the lifeguard identification device comprises an indicia fabric having a vertical dimension smaller than a vertical dimension from a lower edge to an upper edge of the unitary collar, where the indicia are disposed thereon. In this further embodiment the indicia fabric may be made from a natural stretchable elastic fabric or a synthetic stretchable elastic fabric or a combination thereof. In both embodiments the indicia may identify a user as a certified lifeguard.

In both embodiments the unitary collar may comprises a first end and a second end, where the first end is removably fastenable to the second end. Also in both embodiments the unitary collar may be made from a stretchable elastic fabric. In addition the unitary collar may have a vertical dimension of about 2 inches to about 3 inches. Furthermore the unitary collar may be made stretchable to a circumference of about 20 inches to about 25 inches.

In both embodiments each of the plurality of reflective elements may have a vertical dimension equal to or less than a vertical dimension from a lower edge to an upper edge of the unitary collar. Also, the plurality of reflective elements may be uniformly disposed in parallel on the outer surface of the unitary collar at an upper edge thereof and at a lower edge thereof. In one aspect of both embodiments each of the plurality of the reflective elements may be a reflective fabric or a reflective strip. In another aspect of both embodiments each of the plurality of the reflective elements may comprise a reflective paint.

Provided herein are lifeguard identification collars and identification devices. Generally, the collars and devices are unitary such as with a unitary collar body having a plurality of reflective elements and a plurality of indicia each disposed, secured or fastened thereon. The collars and devices enables easy identification of the wearer from a distance particularly via the reflective elements and are designed to be removably worn around the neck of the lifeguard.

The identification collar may be made from natural or synthetic stretchable elastic fabric or similar material whereby the collar may be stretched and slipped over the head for fitting around the neck. For example, the collar is made from LYCRA, a polyurethane-based synthetic fiber made by the DuPont Company. Alternatively, the collar is made by combining LYCRA fibers with other natural fibers, for example, cotton, and/or synthetic, for example, polyester fibers, which makes the identification collar breathable and comfortable to the wearer and also keeps it water and sweat resistant. Stretchable elastic fabric enables the user to easily secure it around the neck or slip it over the head to the neck region.

The collar may be ring-like in shape and may have any suitable circumference that enables a comfortable fit around the lifeguard's neck. The collar is stretchable so it may be passed over the head and fitted around the neck. In a non-limiting example the collar may have a circumference from about 20 inches to about 25 inches. Alternatively, the collar may be linear in shape and have a first end and a second end to which is attached a fastening means or fasteners whereby the collar may be wrapped around the neck and removably fastened. The fastening means or fasteners may be, but are not limited to, hooks, VELCRO, or snaps.

The reflective elements enable patrons to easily identify the wearer from a distance. Any commercially available reflective element including, but not limited to, a reflective fabric, a reflective strip and a fabric painted with reflective paint or reflect paint painted on the collar may be used for this purpose. For example, but not limited to, the reflective element may be a resin based waterproof tape such as a Department of Transportation type 3 reflective tape. The reflective element has a maximum vertical dimension no greater than the vertical dimension of the collar. The reflective element has a horizontal length from about 1 inch to about 2 inches. The reflective elements are disposed in parallel on the collar and may extend downwardly from the upper edge of the collar to the lower edge there of or, alternatively, may extend partially downwardly from the upper edge of the collar and partially upwardly from the lower edge such that a central region of the collar is available for attaching the indicia or the indicia fabric thereto.

The indicia provide a visual aid for patrons to identity that the person wearing the identification collar is a certified lifeguard. The indicia may include a combination of symbols representing first aid and the identifier LIFEGUARD disposed around the circumference of the collar or disposed on the front and on the back of the collar so patrons are able to identify the lifeguard from any direction. The indicia are either knitted, painted or printed on the collar using waterproof permanent ink. The indicia may also comprise a reflective fabric, a reflective strip and or reflective paint to improve visibility for easier identification of the lifeguard.

Alternatively, the indicia may be attached onto a stretchable indicia fabric using an elastic attachment means, for example, an elastic thread, so that the indicia fabric is stretchable when the identification collar is stretched. The indicia fabric may be made from the natural or synthetic stretchable elastic fabric as used for the unitary collar or unitary collar body. The indicia are either knitted, painted or printed using any water and sweat proof permanent ink including, but not limited to reflective paint to improve identification for the lifeguard. The indicia may have a color that contrasts with the collar body and/or the indicia fabric, such as, but not limited to, white indicia against a dark colored background, black indicia against a white background, yellow indicia against a black background, or red indicia against a white background.

Particularly, embodiments of the present invention are better illustrated with reference to the Figure(s), however, such reference is not meant to limit the present invention in any fashion. The embodiments and variations described in detail herein are to be interpreted by the appended claims and equivalents thereof.

FIG. 1 is a front view of a lifeguard identification device 1. The device comprises a collar 2 with an outer surface 2*a*, an inner surface 2*b*, an upper edge 2*c* and a lower edge 2*d*. A plurality of reflector elements, as represented by 3, are disposed circumferentially in parallel around the upper and lower edges on the outer surface of the collar. Indicia, represented by 4, are circumferentially disposed on an indicia fabric 5, which itself is circumferentially attached to the outer surface of the collar. The indicia identify the wearer as a certified lifeguard and the first aid symbol of the American Red Cross.

Figure 2:
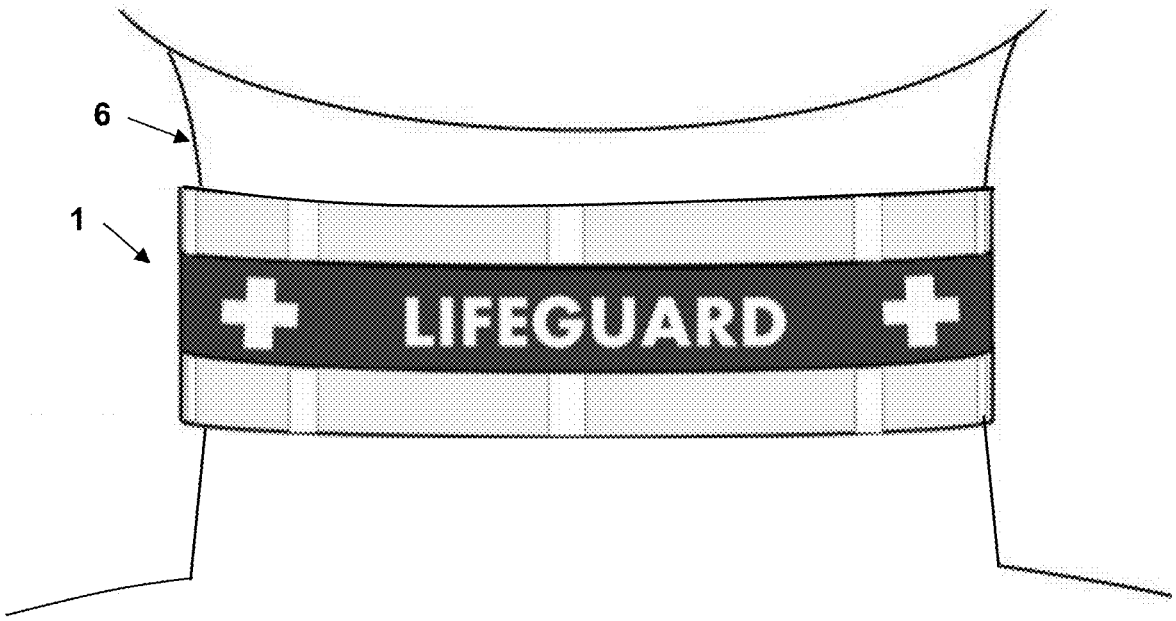
FIG. 2 is a front view of a lifeguard identification device fitted around the neck of a user.

FIG. 2 is a front view of a lifeguard identification device 1 fitted around the neck 6 of a user.

What is claimed is:

1. A lifeguard identification device, consisting of:

a unitary collar having an outer surface and an inner surface;

a plurality of reflective elements circumferentially disposed on the outer surface of the collar; and a stretchable indicia fabric secured circumferentially to the outer surface of the unitary collar; and a plurality of indicia circumferentially disposed on the indicia fabric consisting of first aid symbols and letters that spell lifeguard.

2. The lifeguard identification device of claim 1, said indicia fabric having a vertical dimension smaller than a vertical dimension from a lower edge to an upper edge of the unitary collar.

3. The lifeguard identification device of claim 1, wherein the stretchable indicia fabric is made from a natural stretchable elastic fabric or a synthetic stretchable elastic fabric or a combination thereof.

4. The lifeguard identification device of claim 1, wherein the unitary collar has a vertical dimension of about 2 inches to about 3 inches.

5. The lifeguard identification device of claim 1, wherein the unitary collar is stretchable to a circumference of about 20 inches to about 25 inches.

6. The lifeguard identification device of claim 1, wherein the unitary collar is made from a stretchable elastic fabric.

7. The lifeguard identification device of claim 1, wherein each of the plurality of the reflective elements is a reflective fabric or a reflective strip.

8. The lifeguard identification device of claim 1, wherein each of the plurality of the reflective elements comprises a reflective paint.

9. The lifeguard identification device of claim 1, wherein each of the plurality of reflective elements has a vertical dimension equal to or less than a vertical dimension from a lower edge to an upper edge of the unitary collar.

10. The lifeguard identification device of claim 1, wherein the plurality of reflective elements are uniformly disposed in parallel on the outer surface of the unitary collar at an upper edge thereof and at a lower edge thereof.

11. An identification collar for a lifeguard, consisting of:

a unitary collar body having an upper edge and a lower edge that define a center region therebetween and comprising a stretchable fabric;

at least one pair of reflective elements longitudinally disposed in parallel around an outer surface of the unitary collar body at the upper edge and at the lower edge thereof; and an indicia fabric secured circumferentially to the center region of the unitary collar body with a plurality of indicia circumferentially secured thereon consisting of first aid symbols and letters that spell lifeguard.

12. The identification collar of claim 1, wherein the indicia fabric is a stretchable fabric.

13. The identification collar of claim 12, wherein the indicia fabric is made from a natural stretchable elastic fabric or a synthetic stretchable elastic fabric or a combination thereof.

14. The identification collar of claim 1, wherein the unitary collar body has a vertical dimension between the upper edge and the lower edge of about 2 inches to about 3 inches.

15. The identification collar of claim 1, wherein the unitary collar body is stretchable to a circumference of about 20 inches to about 25 inches.

16. The identification collar of claim 1, wherein the unitary collar body is made from a stretchable elastic fabric.

* * * * *